US005131571A

United States Patent [19]

Nolley

[11] Patent Number: 5,131,571

[45] Date of Patent: Jul. 21, 1992

[54] UNIVERSAL COUPLING SPOUT APPARATUS

[76] Inventor: Roy G. Nolley, 2908 Harwood #102 D, Bedford, Tex. 76021

[21] Appl. No.: 636,897

[22] Filed: Jan. 2, 1991

[51] Int. Cl.[5] ..... B67D 3/00

[52] U.S. Cl. ..... 222/1; 222/108; 222/527; 222/530; 222/538; 222/567; 222/570

[58] Field of Search ..... 222/526, 527, 528, 530, 222/531, 538, 567, 570, 571, 108, 545, 1; 220/85 SP

[56] References Cited

U.S. PATENT DOCUMENTS

| | | | |
|---|---|---|---|
| 2,098,128 | 11/1937 | Bailey | 221/32 |
| 2,641,376 | 6/1953 | Parziale et al. | 215/78 |
| 2,684,793 | 7/1954 | Warrick | 222/567 |
| 2,773,631 | 12/1956 | Bryant | 222/528 X |
| 3,055,556 | 9/1962 | Hester | 222/530 X |
| 3,181,743 | 5/1965 | Libit et al. | 222/530 X |
| 3,537,623 | 11/1970 | Fisher | 222/460 |
| 4,832,238 | 5/1989 | Taylor | 222/529 |

*Primary Examiner*—David H. Bollinger

*Attorney, Agent, or Firm*—Hubbard, Thurman Tucker & Harris

[57] ABSTRACT

A flexible, generally tubular shaped spout device for use in dispensing fluids from containers having threaded or unthreaded openings. A hemispherical flange is included on a lower open end of the spout device which allows for flexible enlargement of a sealing ring upon compression of the external surfaces of the flange. Dimensions of the flexible spout are such that the spout may be centrally folded and latched in a retaining ring to create a seal between the lower open end and the upper open end of the spout.

15 Claims, 1 Drawing Sheet

UNIVERSAL COUPLING SPOUT APPARATUS

BACKGROUND OF THE INVENTION

The applicable art to the present invention relates generally to spout devices which are attached to containers in order to more easily direct the flow of liquid poured from the containers. The art to which this invention relates has become increasingly crowded with complex multipiece devices which are difficult to attach and relatively expensive to manufacture.

Many various types of oil spouts are known in the prior art. For example, it is known in the art to provide attachment of the spout to a container by the use of mating threads which engage and seal the spout onto the container. U.S. Pat. No. 2,641,376 by Parziale et al dicloses such a device. Parziale discloses a dispensing cap for bottles which employs threads in the cap which when mated with the threads of a container form a liquid tight seal between the container and the cap. Further, Parziale discloses a complex device to close the spout. This device includes a resilient coupling placed between the cap of the device and its rigid nozzle which supplies force to press the nozzle against a suspended ball within the nozzle. The contact of the suspended ball against the interior of the nozzle constricts the flow of liquid poured from the attached container.

While the arrangement discussed by Parziale allows some control of the dispensed liquid, it is relatively complex and expensive to construct. Further, it does not achieve a quick and easy method of coupling the nozzle to a threaded container.

A similar dispensing spout is disclosed in U.S. Pat. No. 4,832,238 by Taylor. Taylor teaches that a corrugated, flexible conduit may be attached to the neck of a threaded container by the use of rigid mating threads in the base of the device. Further, Taylor discloses a complex magnetic butterfly valve placed in the base of the spout to control the flow of liquid from the container through its corrugated section. Taylor also discloses the use of mating "snap" caps which may be applied to each end of the spout when not in use, or which may be used to achieve a closure of the container when the spout is in use. The separate caps which form closures to each end of the device are tethered to the spout with thin, flexible retaining straps. Such straps are subject to being broken and the separate caps lost with repeated usage. Further, as with Parziale, the implementation of the Taylor device is relatively expensive and complex, requiring an added magnetic valve and multiple separate caps.

The art also disclosed many devices which employ annular grooves for sealing spout mechanisms onto containers.

U.S. Pat. No. 3,537,623, by Fisher, discloses a complex, multipiece spout which is designed to snap onto a motor oil can having a generally cylindrical shape and a raised annular ridge around the perimeter of the top of can. The Fisher device is essentially a flexible frustroconical spout with flexible annular grooves on the inside of the lower flared portion. This device may be pressed onto the oil container engaging the annular grooves over and into engagement with the extended annular ridge on the container. The friction created between the annular grooves and the container ridge serves to hold the spout in place as the container is inverted.

Fisher also discloses a separate threaded cap which may be applied to the top of the spout to form a closure of the container when not in use.

The device taught in Fisher is more complex to construct and more difficult to use than the present invention. Further, the Fisher device must be used with containers which have an extended annular ridge around the perimeter of the top which is not required by the present invention. Also, the closure of the device is achieved by a separate cap which is more easily lost than the closure provided by the present invention.

U.S. Pat. No. 2,098,128, by Bailey, also discloses a spout which attaches to a container through the use of an annular groove. As with Fisher, Bailey requires a specialized container which has an extended annular "rib" onto which the spout is attached. The spout is held on the container by the friction exerted against the container by an annular retaining ring around the base of the spout. The stated purpose of this ring is to restrict the flexibility of the spout.

The device disclosed in Bailey is more difficult to attach to the container than the present invention in that the retaining ring on the spout must be expanded from the inside while concurrently forcing the neck of the container into the bottom of the spout.

Also, Bailey teaches that metal inserts are an advancement which prevent the constriction of the flow of liquid from the container through the nozzle. While this attribute may be valuable in some applications, it virtually precludes the airtight sealing of the container to which the spout is attached. It is, therefore, difficult to use the Bailey device to store volatile liquids or to prevent contamination of liquids resident in the container while the spout is attached.

Overall, these patents do not address the need for a one piece, inexpensive and compact nozzle which is easily and quickly attached to a variety of containers. Additionally, none of the disclosed devices in the prior art teach a device which provides a system of sealing the container while the nozzle is attached by a spout which is in one piece and free from caps or attachments which are easily lost during repeated usage. Additionally, none of the disclosed devices in the prior art teach a flexible flange which, when compressed, expands an internal sealing ring to aide in the ease of attachment of the spout. Finally, none of the devices disclose a flexible shroud which is shaped in such a manner to catch spills and drips which occur upon usage of the nozzle.

Therefore, it is desirable to provide a single unitized spout which provides a quick and convenient method of attachment and detachment to various types of containers. Furthermore, it is desirable to provide a one piece spout which allows for the sealing closure while attached to the container to prevent contamination of the internal fluid or escape through evaporation. Additionally, it is desirable for a spout to have the capacity to catch drips and other spills which occur during the usage of the spout, to provide a spill-proof method of directing the fluid resident in the container. It is also desirable to provide a spout which is pliable and allows the fluid being poured to be directed and its flow to be constricted by bending and pinching of the spout device without added valves or other complex methods of control.

SUMMARY OF THE INVENTION

This invention provides a simple one piece apparatus and method for attachment to various containers with both threaded and nonthreaded openings to control the pouring of fluid from such containers. The invention further possesses the attribute of a means to seal said container from outside contaminants and the outside air without detachment and without the use of separate caps or plugs.

Essentially, the invention carries out five goals. First, it is easily and economically manufactured, thereby being widely available to the public at low cost. Second the apparatus' unitized construction eliminates the need for extra caps which are easily lost, thereby rendering the spout useless for sealing the container. Third, it allows and easy and simple method of directing and constricting the flow of the fluid by bending and pinching of its flexible sections. Fourth, it provides a method to catch drips and spills which occur during the use of the spout and tend to run down the outside of the device. Finally, it provides a new method of easy attachment whereby a sealing ring is expanded by compression of an external flange making it large enough to easily slip over the openings in various containers.

In the preferred embodiment of the present invention, a single piece is formed to provide an elongated tubular section which may be easily manipulated by hand to direct and control the flow of fluid. The singular piece also includes a hemispherical flange at the base of the device which, when compressed from the outside, expands a sealing ring located at the base of the elongated tubular portion. This expansion of the sealing ring allows for easy installation and removal of the device from various containers displaying a variety of closures and openings.

It is anticipated that the preferred embodiment is formed with a circular diameter which is suitable for attachment to motor oil containers having an extended threaded neck. However, the invention could easily be scaled to fit antifreeze or other automotive fluid containers, home and garden containers where even the slightest spill is hazardous or harmful to clothing. While the preferred embodiment is sized to allow the pouring of liquids, it is contemplated within the specifications that the device may be used to direct and seal fine powders or granular substances which may be resident in the containers as well as dispensable liquids.

It is anticipated that the preferred embodiment will be formed out of plastic. However, other materials are contemplated in the specification which provide similar attributes.

The hemispherical flange formation also performs the dual purpose of catching drips which travel down the outside of the elongated tubular portion after the device has been used and is placed in a raised position.

Further, attached to the hemispherical formation of the preferred embodiment is a flexible loop which is designed to retain placement of the upper end of the elongated tubular portion and maintain the elongated portion in a folded position. Such folded position creates a seal between the lower open end of the spout which is connected to the container and the upper open end of the device. Such seal is liquid and airtight preventing leakage and evaporation.

DETAILED DESCRIPTION OF THE PREFERRED EMBODIMENT

Figure 1:
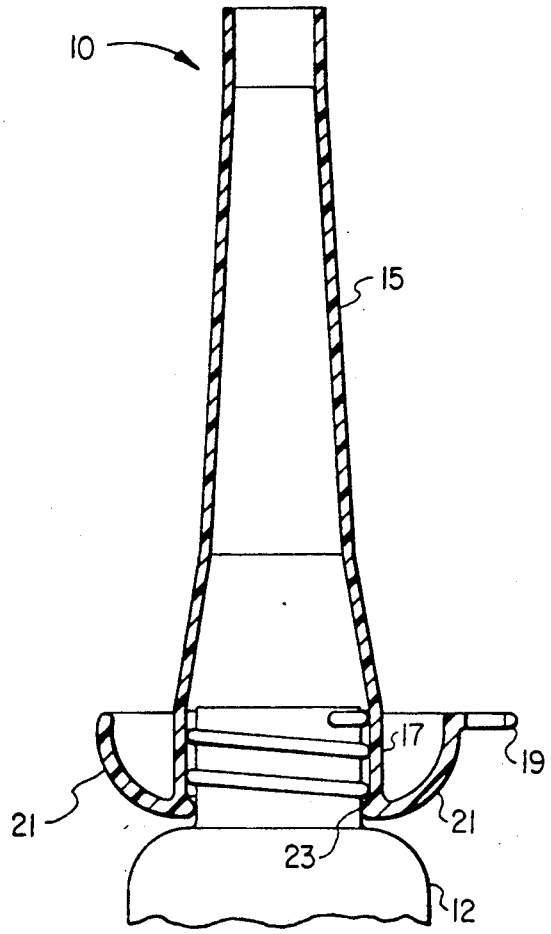
FIG. 1 is a cutaway view of a container equipped with the universal coupling spout apparatus while attached to a container.

FIG. 1 illustrates a sectional view of the universal coupling spout apparatus 10 attached to a container 12 with an extended threaded opening. The spout apparatus 10 includes an elongated frustroconical section 15 which is generally tubular in nature. Frustroconical section 15 is sealingly connected around the perimeter of its base to a cylindrical section 17. Both sections are generally tubular in nature and are held in ducted communication throughout the length of the device.

Cylindrical section 17 has formed, at its base, a flexible internal sealing ring 23. Sealing ring 23 is reduced in diameter from the diameter of the cylindrical section 17 and is sized slightly smaller than the neck of the container on which it is to be used. Around its outer perimeter, sealing ring 23 is attached to and forms a hole in the lower surface of flange means 21. The upper surface of flange means 21 is sealingly connected around the circumference of cylindrical section 17 of the device.

Flange means 21 is a flexible hemispherical section which may be compressed to effect the expansion of sealing ring 23. The expansion of sealing ring 23 is effected by the outward rotation of the lower surface of flange means 21 when a compressive force is applied to the upper side of flange means 21. Since sealing ring 23 is connected to the lower surface of flange means 21, when the lower surface of the flange means is rotated outward, a concurrent rotation of the interior of sealing ring 23 occurs, thus expanding its diameter.

Figure 2:
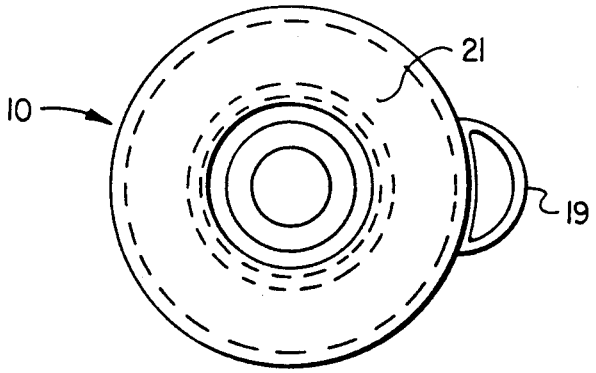
FIG. 2 is a bottom view of the universal coupling spout apparatus unattached to a container.

As shown best in FIG. 2, a spout retaining means 19 is connected to the upper edge of flange means 21. The spout retaining means in the preferred embodiment is a semicircular strap formed into the outer edge of flange means 21. Spout retaining means 19 is of sufficient diameter to allow the insertion of the upper end of frustroconical section 15.

In operation, the spout apparatus is grasped applying pressure to the outside surfaces of flange means 21, deforming the flange and expanding the lower portion of cylindrical section 17 and sealing ring 23. A compressive force applied around the outer edge of flange means 21 causes the lower end of cylindrical section 17 and sealing ring 23 to be expanded, thus enlarging their diameters. The apparatus is then forced onto the threaded or unthreaded neck of a container 12 in which fluid or powder to be dispensed is resident. The pressure is then released from flange means 21 which through its resilient nature returns to its original position. The return of flange means 21 to hemispherical shape causes the constriction of sealing ring 23 around the neck of the container. The spout apparatus 10 is maintained on the container during use by the frictional engagement of sealing ring 23 against the lower portion of the neck of the container 12.

After attachment of the apparatus, the container may be inverted, allowing the fluid resident within to escape out the container opening and into frustroconical section 15 of the apparatus. In order to control the flow of fluid, the frustroconical section 15 may be compressed or pinched shut by the user. After dispensing the desired amount of fluid, the container and the apparatus are raised to the original upright position whereupon any leakage or drips resident on the outside of frustroconical section 15 flow downward and into the concave section formed by flange means 21 and cylindrical section 17.

Figure 3:
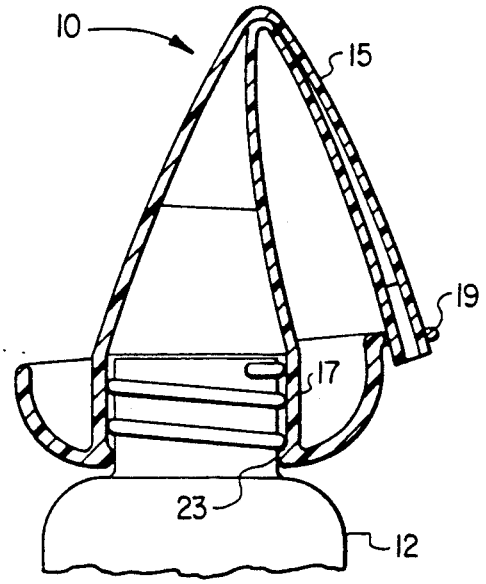
FIG. 3 is a cutaway view of a container equipped with the universal coupling spout apparatus while the device is in its "folded" position.

After usage, the container may be sealed by bending the elongated frustroconical section in two, thus forming a closure. As shown in FIG. 3, once folded, the upper opening of the elongated frustroconical section 15 may be inserted into retaining means 19. The frictional pressure provided by the resilient nature of the frustroconical section 15 against the inside of retaining means 19 causes the frustroconical section to stay in a folded position when released.

As can further be seen from FIG. 3, the fold in frustroconical section 15 causes the collapse of the tubular nature of &he section. This collapse forces contact between the internal surfaces of frustroconical section 15 thus forming a seal between the lower open end of cylindrical section 17 and the upper open end of frustroconical section 15. This closure effectively seals container 12 and prevents escape of the fluid within if the container is accidently inverted and, additionally, prevents the escape of liquid resident in container 12 through evaporation.

In an alternative embodiment, a plug or cap as known in the art may be attached to the upper end of frustroconical section 15 to provide an airtight closure for the apparatus.

The apparatus may be detached from the container by grasping frustroconical section 15 and applying compressive pressure to the outside of flange means 21 whereby again expanding sealing ring 23. The device then may be easily pulled from the container 12.

While the foregoing illustrates and discloses the preferred and other embodiments of the universal coupling spout apparatus, it is to be understood that many changes can be made in the apparatus as a matter of engineering choice without departing from the spirit and scope of the invention as defined by the appended claims.

I claim:

1. The universal coupling spout apparatus comprising:

a. a flexible conduit portion having an internal surface and an external surface, b. said conduit portion having at least one connecting portal at one end and at least one dispensing portal at the other, c. an annular sealing ring formed on the end of said flexible conduit portion at said connecting portal, d. a flexible flange connected to and extending upwardly and outwardly from said external surface of said flexible conduit, adjacent said connecting portal;

e. said flexible flange adapted to flexibly rotate at least a portion of said annular sealing ring outwardly about its circumference when a compressive force is applied to the outwardly and upwardly extending portion of said flexible flange.

2. The coupling spout of claim 1 wherein said flexible conduit portion is adapted to be folded to create a seal between said connecting portal and said dispensing portal.

3. The coupling spout of claim 2 wherein said flexible flange includes a retaining means for retaining said flexible conduit portion in said folded position thereby maintaining said seal.

4. The coupling spout of claim 1 wherein said flexible flange is adapted to form a concave cavity with said external surface of said flexible conduit portion.

5. A universal coupling spout apparatus comprising:

a. a pliable, generally tubular portion having inside and outside surfaces and an upper open end held in ducted communication with a lower open end, b. said inside surface of said tubular portion including an annular sealing ring of smaller diameter than said tubular portion directly adjacent and interior to said lower end, c. said lower end being adapted to form a flared shroud extending outwardly and upwardly from said lower end, d. said lower end being adapted to flexibly rotate said annular sealing ring outwardly about its toroidal axis when a constrictive force is applied to the outwardly and upwardly extending portion of said flared shroud formed by said lower end.

6. The coupling spout of claim 5 wherein:

a. said pliable, tubular portion is adapted to allow a folded relation between said upper and lower ends, constricting said ducted communication between said upper and lower ends.

7. The coupling spout of claim 6, wherein said flared shroud includes a retaining means for retaining said pliable, generally tubular portion in said folded position thereby maintaining said seal.

8. The coupling spout of claim 5 wherein said flared shroud is adapted to catch liquid traveling down said outside surface of said tubular portion when said coupling spout is in a raised position.

9. A universal coupling spout apparatus comprising:

a. a hollow generally frustroconical section having a smaller open end held in ducted communication with a larger open end, b. said larger open end of said frustroconical section adapted to form an orifice, c. a hemispherical section adapted to extend outwardly from said larger open end of said frustroconical section, d. said hemispherical section extending from said orifice outwardly and upwardly toward said smaller open end, e. said hemispherical section being adapted to flexibly expand said orifice when a compressive force is applied equatorially to said hemispherical section.

10. The coupling spout of claim 9 wherein said frustroconical section being adapted to be bent to create a generally fluid tight crease seal between said larger open end of said frustroconical section and said smaller open end of said frustroconical section.

11. The coupling spout of claim 10 wherein said hemispherical section includes a retaining means for maintaining said frustroconical section in said bent condition thereby maintaining said crease seal.

12. The coupling spout of claim 9 wherein:

a. said hemispherical section is adapted to retain liquid adhering to and traveling down said frustroconical section when said coupling spout is in a raised position.

13. Removably attaching coupling spout comprising a flexible tubular section, a reduced diameter sealing ring and flexible flange to a container having an outlet, comprising the steps of:

a. compressing said flexible flange effecting the enlargement of said sealing ring, b. placing said sealing ring over said outlet on said container, c. relaxing said flexible flange effecting the constriction of said sealing ring.

14. The method of claim 13 comprising the further steps of:

a. detaching said coupling spout by:

1. compressing said flexible flange effecting the enlargement of said sealing ring, 2. forcing said coupling spout off said container.

15. A method of controlling the flow of fluid escaping from a container with an outlet comprising the steps of:

a. Attaching a coupling spout comprising a flexible tubular section, a reduced diameter sealing ring and a flexible flange to a container having an outlet, comprising the steps of:

1. compressing said flexible flange effecting the enlargement of said sealing ring, 2. placing said sealing ring over said outlet on said container, 3. relaxing said flexible flange effecting the constriction of said sealing ring;

b. inverting said container causing fluid to escape from said container, c. bending said flexible tubular section to direct said escaping fluid, d. compressing said flexible tubular section to constrict the flow of said escaping fluid.

* * * * *

UNITED STATES PATENT AND TRADEMARK OFFICE

CERTIFICATE OF CORRECTION

PATENT NO. : 5,131,571
DATED : July 21, 1992
INVENTOR(S) : Roy G. Nolley

It is certified that error appears in the above-indentified patent and that said Letters Patent is hereby corrected as shown below:

Column 3, line 18, change "and easy" to --an easy--.

Column 5, line 22, change "&he" to --the--.

Column 5, line 49, change "The universal coupling" to --A universal coupling--.

Claim 12, line 2, delete the subparagraph identifier "a." following "wherein:".

Claim 13, line 1, change "Removably attaching coupling" to --A method of removably attaching a coupling--.

Claim 14, line 3, delete the subparagraph identifier "a." following "the further steps of:".

Signed and Sealed this

Twenty-second Day of February, 1994

*Attest:*

*Attesting Officer*

BRUCE LEHMAN

*Commissioner of Patents and Trademarks*